US005285917A

United States Patent [19]

Hofmann

[11] Patent Number: 5,285,917

[45] Date of Patent: Feb. 15, 1994

[54] SAFETY CLOSURE FOR CONTAINERS

[75] Inventor: Richard W. Hofmann, Chicago, Ill.

[73] Assignee: Magenta Corporation, Chicago, Ill.

[21] Appl. No.: 848,825

[22] Filed: Mar. 11, 1992

[51] Int. Cl.[5] ..... B65D 39/16; B65D 43/26

[52] U.S. Cl. ..... 220/212.5; 220/281; 220/282; 220/285; 220/307; 220/752; 220/761; 220/768; 215/224; 215/295; 215/296; 215/305; 215/211

[58] Field of Search ..... 220/212, 264, 281, 282, 220/285, 307, 94 A, 752, 757, 761, 768; 215/211, 213, 216, 224, 225, 228, 237, 295, 296, 298, 301, 305

[56] References Cited

U.S. PATENT DOCUMENTS

| | | | |
|---|---|---|---|
| 1,659,155 | 2/1928 | Peterson | 220/212 |
| 3,398,847 | 8/1968 | Towns | 215/216 |
| 3,604,583 | 9/1971 | Linkletter | 215/213 |
| 3,845,872 | 11/1974 | Towns et al. | 215/224 |
| 4,303,171 | 12/1981 | Schremmer | 220/238 |
| 4,358,022 | 11/1982 | Geiger | 215/224 |
| 4,377,236 | 3/1983 | Montgomery | 220/282 X |
| 4,504,009 | 3/1985 | Bolk et al. | 220/307 X |
| 4,607,768 | 8/1986 | Taber et al. | 215/237 X |
| 4,832,221 | 5/1989 | Manem | 215/237 |
| 4,850,504 | 7/1989 | Grindrod et al. | 220/307 |
| 4,923,085 | 5/1990 | Lillelund et al. | 220/282 |

*Primary Examiner*—Allan N. Shoap
*Assistant Examiner*—Vanessa Caretto
*Attorney, Agent, or Firm*—Laff, Whitesel, Conte & Saret

[57] ABSTRACT

A child-resistant container closure constructed according to the present invention comprises a disk shaped cover plate attached to body section formed as a substantially cylindrical wall. A movable handle or tab is attached to the cover plate to aid a user in pulling the closure from a container in which the closure is installed. A well or recess is provided in cover plate to house the handle in a closed position. A ridge on the end of the handle cooperates with a mating ridge in the wall of the recess to retain the handle in a closed position. A resilient spring is provided in the recess so that when the handle is released from the recess, it is urged into a position in which it may be conveniently gripped by a user. An undercut groove or notch is provided on the outside surface of the cylindrical wall adjacent the cover plate. The notch engages a mating lip or ridge extending inward from the inner surface of the mouth of the product container to secure the closure to the product container. The depth of the notch is gradually reduced along a predetermined angular portion thereof to reduce the amount of force required to remove the closure from the container.

7 Claims, 8 Drawing Sheets

SAFETY CLOSURE FOR CONTAINERS

BACKGROUND OF THE INVENTION

This invention relates to container closures, and more particularly to closure devices for prohibiting access to container contents by children while permitting such access by adults.

Many useful products, such as medicines and household cleaners, cannot be made inherently safe from improper use by children and others who may be unable to appreciate the danger presented by the product. A common problem with the distribution of such products is prohibiting access to the product by children while permitting access by adults. Accordingly, a variety of child resistant closures have been developed for use with common product containers. Such closures generally include an obstacle which is intended to be relatively difficult for a child to avoid but which can be easily overcome by an adult.

U.S. Pat. No. 3,845,872 discloses a child resistant closure plug for use with a container having a substantially cylindrical mouth. The closure has a cylindrical body portion which extends into the mouth of the container, and a disk-shaped cover portion which is attached to the body. An undercut groove or notch is provided on the outside surface of the cylindrical body portion where it meets the cover. A corresponding lip is provided on the inside wall of the container mouth to engage the undercut groove. The groove and lip thus cooperate to retain the closure in the container, and substantial force is required to overcome the cooperation of these elements to remove the closure.

A hinged flap or tab is provided in the cover to serve as a handle or lever f or removing the closure from the container. A recess is provided in the cover in which the tab may be retained in a closed position when it is not being used to remove the closure from the container. When the tab is in its closed position, its upper surface is substantially flush with the upper surface of the cover. The tab and recess have cooperative means to release the tab when downward pressure is applied at a predetermined position.

Because it is extremely difficult to remove the closure from the container without using the tab handle, and because the handle is captured in its recess unless downward pressure is applied at the correct location, it is difficult for children to remove the closure. The fact that the upper surface of the handle is flush with the upper surface of the cover conceals the existence of the handle and the proper method for releasing it. Thus, children are unlikely to discover the handle or discern the method for releasing it through inspection. A legend, which younger children cannot read, may be inscribed on the cover or container to instruct adults concerning removal of the closure.

Although the prior art closure described above appears to adequately protect against access by children, it is also relatively difficult for some adults to operate. Several features of the prior art closure create obstacles which are particularly difficult for people with poor eyesight, impaired coordination, limited strength, or other disabilities, to overcome. In particular, the retaining groove of the prior art closure cooperates so well with the inside lip of the container mouth that the large amount of force required to pull the closure from the container exceeds the capability of many product users. In addition, once the handle of the prior art closure has been released f rom its recess, it tends to remain in a position very close to the upper surf ace of the closure. It is difficult for some users to see the handle in that position. For other users, particularly those with limited manual dexterity or other coordination problems, it is difficult to move the handle into a position displaced from the top surface of the closure so that it may be gripped for use.

OBJECTS AND SUMMARY OF THE INVENTION

It is therefore an object of the present invention to provide a child-resistant closure which requires less force for removing the closure from a container than prior art closures.

It is another object of the invention to provide a child-resistant closure having a handle which automatically moves into a position convenient for use when released from a recessed position.

It is a further object of the invention to provide a child-resistant closure which is easier for disabled persons to operated than prior-art closures.

An improved child-resistant container closure constructed according to the present invention comprises a resilient spring mounted under a pop-up handle which may be employed by a user to pull the closure from a container. The spring automatically urges the handle into a position in which it may be conveniently gripped by a user whenever the handle is released from its closed position. In addition, the undercut groove which is provided on the outside surface of the cylindrical wall to retain the closure in the product container is modified to reduce the amount of force required to remove the closure from the container. The depth of the notch is gradually reduced along a predetermined angular portion thereof to reduce the amount of force required to remove the closure from the container.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

Figure 1:
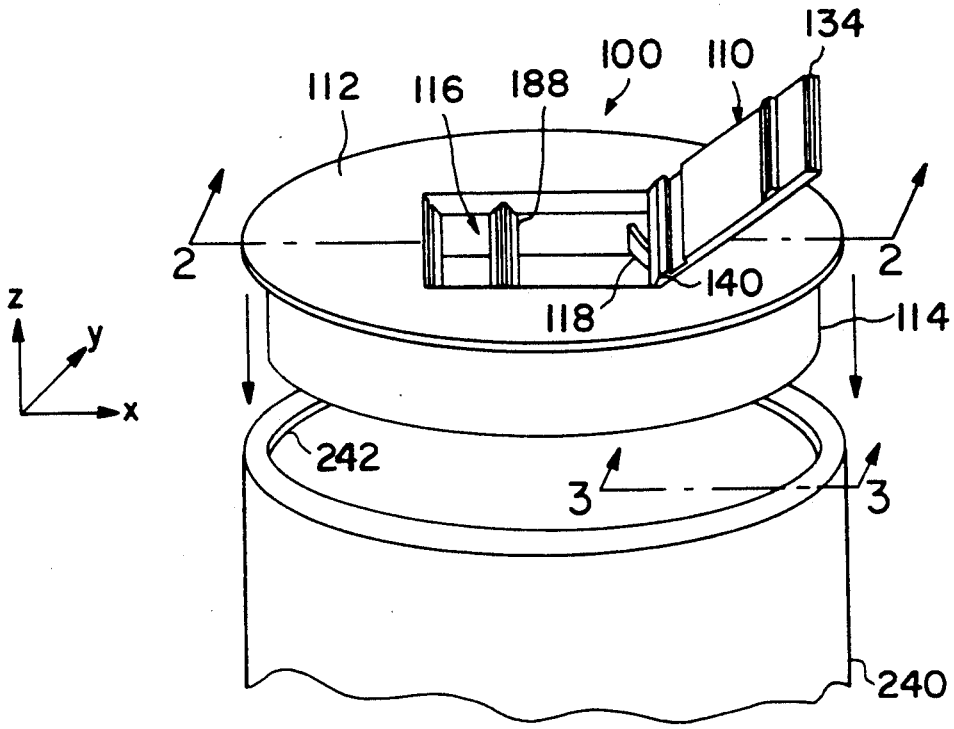
FIG. 1 is a perspective view of a child-resistant container closure constructed according to the present invention, showing the pull handle thereof in an opened position.
Figure 6:
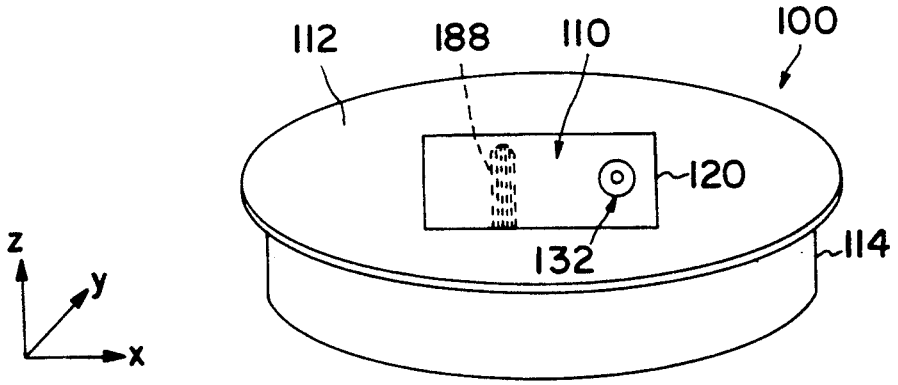
FIG. 6 is a perspective view of the closure of FIGS. 1-5 showing the pull handle thereof in a closed position.

Perspective views of a child-resistant container closure 100 constructed according to the present invention are shown in FIGS. 1 and 6. Additional detailed views of the closure are shown in FIGS. 2-5. Reference axes X, Y, and Z are defined for convenient reference. The closure 100 has a disk shaped cover plate 112 attached to body section formed as a substantially cylindrical wall 114. A movable handle or tab 110 is attached to the cover plate 112 to aid a user in pulling the closure 100 from a container 240 (FIG. 1) in which the closure is installed. A well or recess 116 is provided in cover plate 112 to house the handle 110 when it is in a closed position. A ridge 134 on the end of the handle cooperates with a mating ridge 154 (FIG. 2) in the wall of the recess 116 to retain the handle 110 in a closed position. A resilient spring member 118 (FIGS. 1, 2 and 4) is provided in the recess 116 so that when the handle 110 is released from the recess 116, it is urged into a position in which it may be conveniently gripped by a user.

An undercut groove, channel, or notch 198 is provided on the outside surface of the cylindrical wall 114 adjacent the cover plate. The notch 198 engages a mating lip or ridge 242 (FIG. 1) extending inward from the inner surface of the mouth of the product container to secure the closure 100 to the product container. The depth of the notch 198 is gradually reduced along a predetermined angular portion thereof to reduce the amount of force required to remove the closure 100 from the container.

In greater detail, the closure 100 has a disk shaped cover plate 112 attached to a substantially cylindrical body wall 114. The cover plate 112 has a somewhat larger diameter than the body wall 114 to form a radially extending overhang 156. The overhang interferes with the container walls and prevents the cover plate 112 from being inserted below the top of the mouth of the container. The cylindrical body wall 114 has an interior wall surface 162 which preferably extends perpendicularly from the cover plate 112. The closure 100 may be formed using any suitable material and manufacturing process. For example, the closure 100 probably is a one-piece molded plastic closure, constructed f rom an appropriate plastic resin, i.e., polyethylene, polypropylene, polyvinyl chloride, and appropriate polymers and copolymers.

Figure 2:
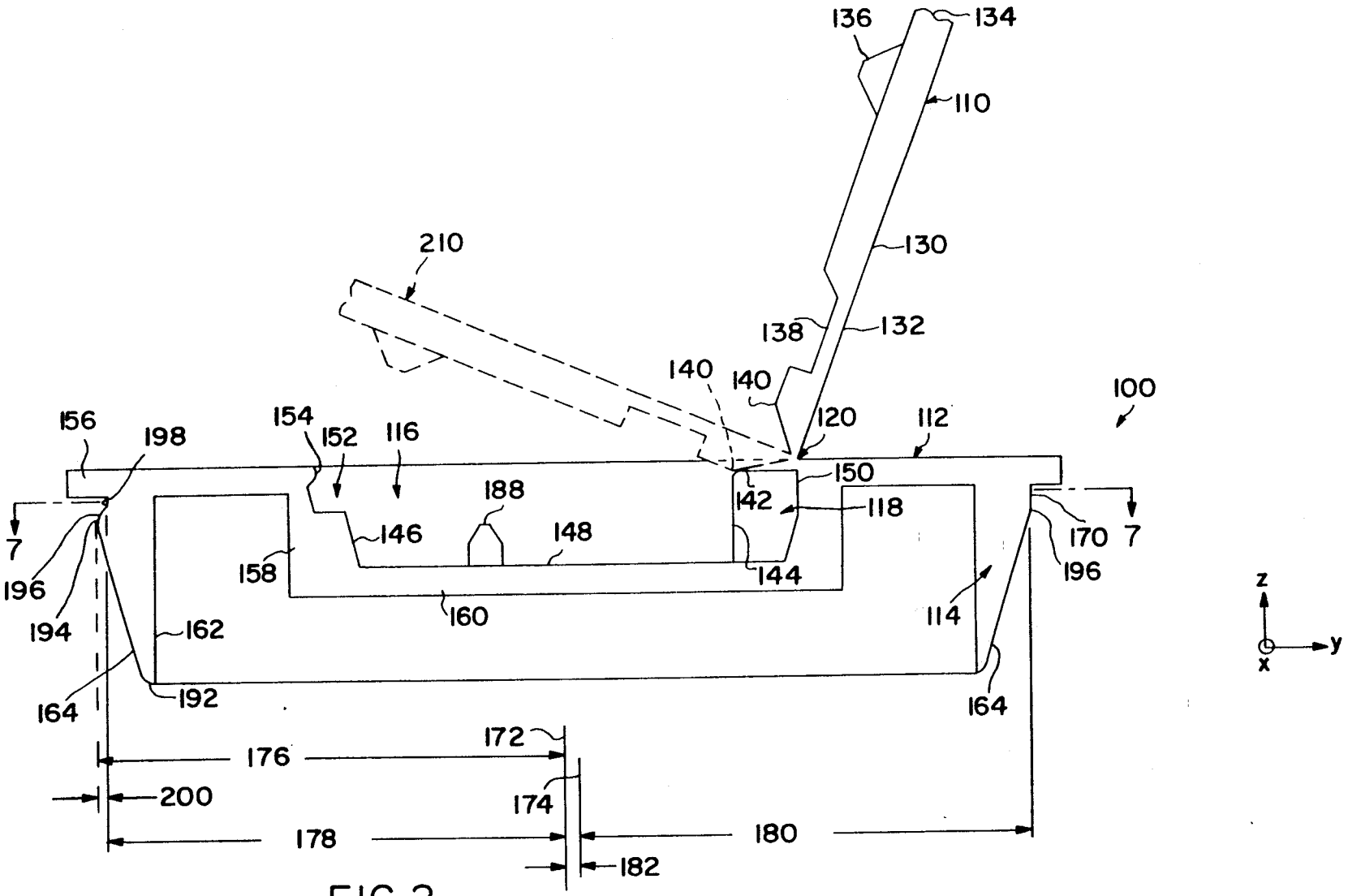
FIG. 2 is a side cross-section view of the closure of FIG. 1 taken along the view lines 2—2 thereof.
Figure 3:
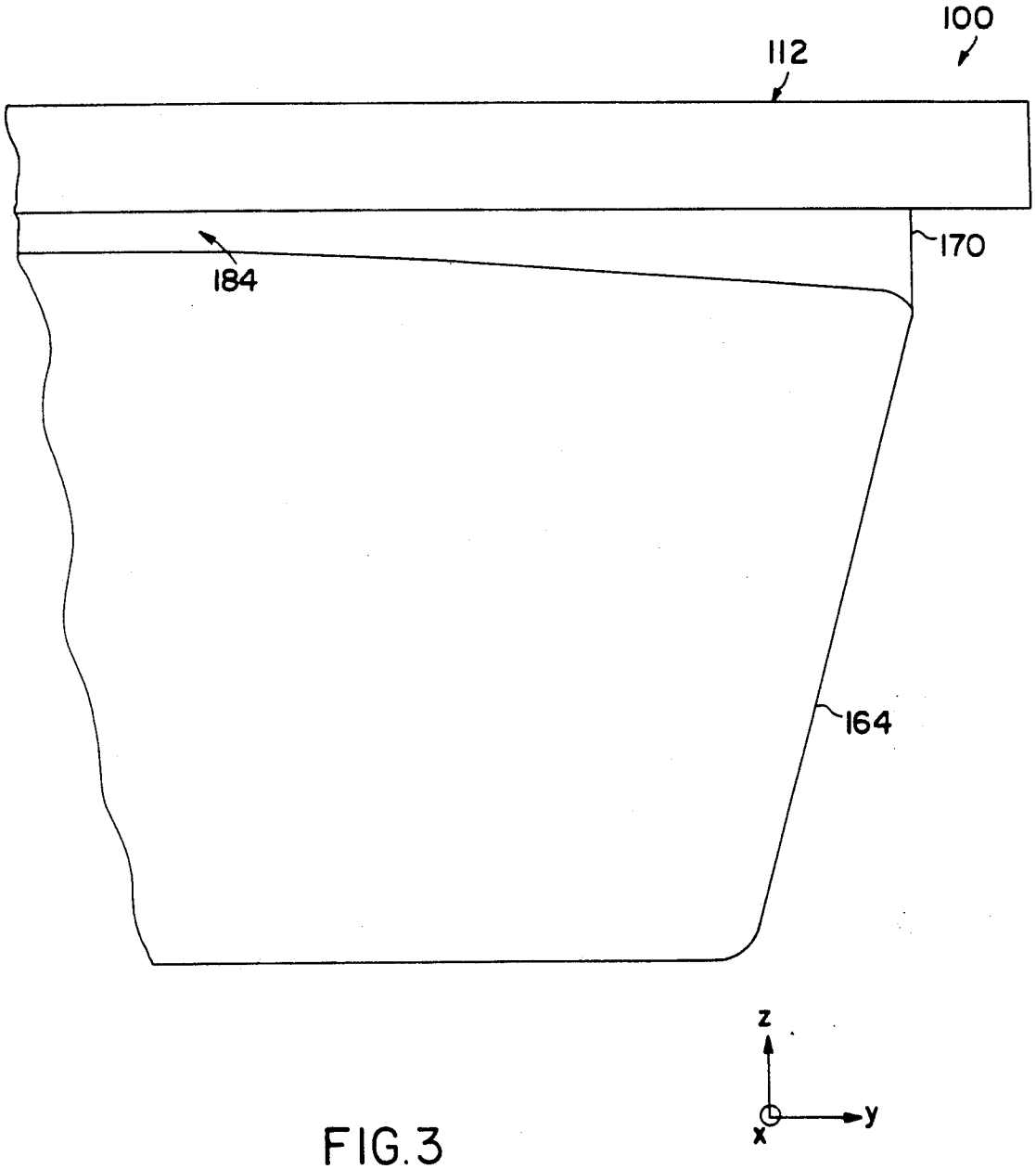
FIG. 3 is an enlarged side elevation view of the closure of FIGS. 1-2 taken along the view lines 3—3 of FIG. 1.

The cylindrical body wall 114 has an angled exterior wall surface 164 extending upward and outward from the bottom end 192 of the cylindrical body wall 114 to the cover plate 112. Thus the interior and exterior wall surfaces 162 and 164 define the cross-sectional shape of the cylindrical body wall 114 which is comparatively thin at the bottom end 192 and which increases in thickness as it approaches the cover plate 112. As best seen in FIG. 2, the thickness of the cylindrical body wall 114 increases until it reaches a section 196 of maximum thickness. An undercut groove or notch 198 is provided in the exterior surface of the cylindrical body wall 114 adjacent the cover plate 112. Because the undercut groove 198 has an outer diameter smaller than that of the maximum thickness section 196 of the wall, these components cooperate to form an annular ridge 194. The annular ridge 194 interferes with a lip or ridge 242 (FIG. 1) which is formed on the interior wall of the mouth of the product container and which extends into the undercut groove.

In order to remove the closure 100 from the product container, the annular ridge 194 on the exterior surface of the body wall 114 must be urged past the mating inner lip 242 (FIG. 1) in the mouth of the product container. In typical prior art closures, the undercut groove and annular ridge extend along the entire circumference of the cylindrical body wall, so that even though the container and the closure may be constructed of comparatively resilient materials, the force required to urge the annular ridge 194 past the container lip 242 is undesirably large.

Accordingly, in the inventive closure 100 the undercut groove 198 is modified to provide a region 202 in which the depth of the undercut groove 198 is smoothly reduced from its maximum depth to zero. The reduced-depth region 202 allows the product container lip 242 to more easily pass the the maximum thickness section 196 of the wall and thereby reduces the amount of force required to remove the closure 100 from the container.

Figure 7:
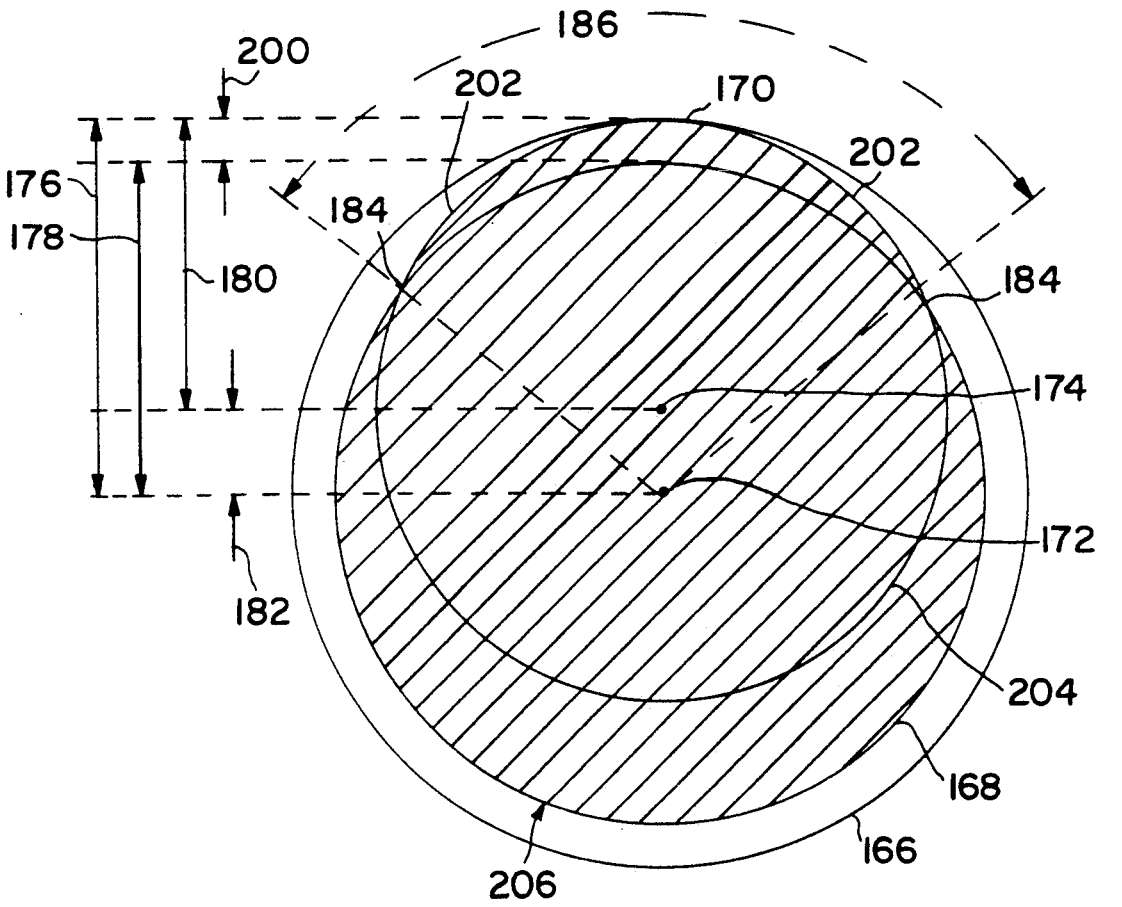
FIG. 7 is a simplified cross-sectional diagram taken along the view lines 7—7 of FIG. 2 showing the geometry used to form an undercut retaining groove on the inventive closure of FIGS. 1-6.
Figure 7:
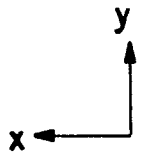
Figure 8:
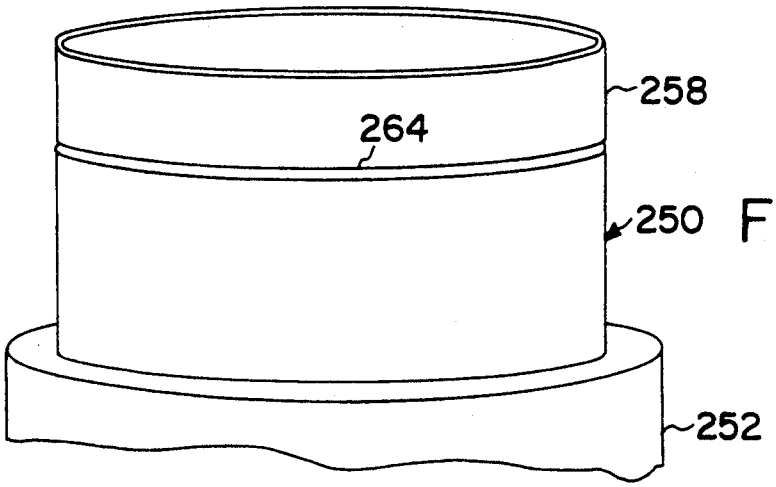
FIG. 8 is a side perspective view of a first alternative configuration for retaining means for the closure of FIGS. 1-6.

The geometry of the undercut groove 198 and the maximum-thickness section 196 is best seen in FIGS. 2 and 7. FIG. 7 is a simplified cross sectional view through the undercut groove 198 in which the dimensions have been exaggerated to show this geometry more clearly. Interior features of the closure 100 are omitted in FIG. 7. The shape of the maximum thickness section 196 of the cylindrical body wall 114 is defined by a first cylinder 166 having a central axis 172 and a radius 176. In typical prior art closures, the shape of the undercut groove has been defined by a second concentric cylinder having a slightly reduced radius. Thus, in the prior art, the "depth" of the undercut groove (with respect to the maximum-thickness region) remains constant over its entire circumference and is determined by the difference between the radii of the first and second cylinders.

In contrast to the prior art closures, the shape of the undercut groove 198 of the inventive closure is preferably defined by the union of second and third non-concentric cylinders 168 and 204. This union is denoted by shading in FIG. 7. Second cylinder 168 shares the central axis 172 of first cylinder 166, but has a slightly reduced radius 178. Third cylinder 204 has a central axis 174 and a radius 180. Central axis 174 of the third cylinder 204 is preferably displaced along the Y-axis by an amount 182 equal to the difference in radius between the first cylinder 166 and the third cylinder 204, such that the first and third cylinders intersect at 170.

Because the shape of the undercut groove 198 is defined by the union of the second and third cylinders 168, 204, the groove 198 follows the outermost boundary of those cylinders. Thus, as seen in FIG. 7, at positions "below" the intersections 184 of the cylinders, the difference between the radius 176 of the first cylinder and the radius 178 of the second cylinder is shown as dimension 200 and determines the depth of the undercut groove 198 over a large portion 206 of its circumference. However, at is positions above the intersection points 184, the depth of the undercut groove 198 is determined instead by the distance between first cylinder 166 and third cylinder 204. This distance diminishes smoothly to zero at the intersection 170 of the first and third cylinders, creating a reduced depth region 202 of the undercut groove 198.

As seen in FIGS. 2–5 and 7, at the intersection 170 of the first and third cylinders, the undercut groove 198 radially coincides with the maximum-thickness section 196 of cylindrical body wall 114—that is, the groove 198 has effectively vanished and there is no difference in radius between it and the maximum thickness section 196. At that location, the maximum thickness section 196 no longer creates an annular ridge 194, and the lip 242 on the interior wall of the container mouth may move past it with relative ease. As a result, during removal, the portion of the closure 100 near intersection 170 tends to be released from the container first, and therefore, the closure 100 tends to tip or cant during removal. The angled exterior wall surface 164 allows the closure 100 to be tipped or angled with respect to the mouth of the container as the closure 100 is removed without interfering with the walls of the container.

Figure 4:
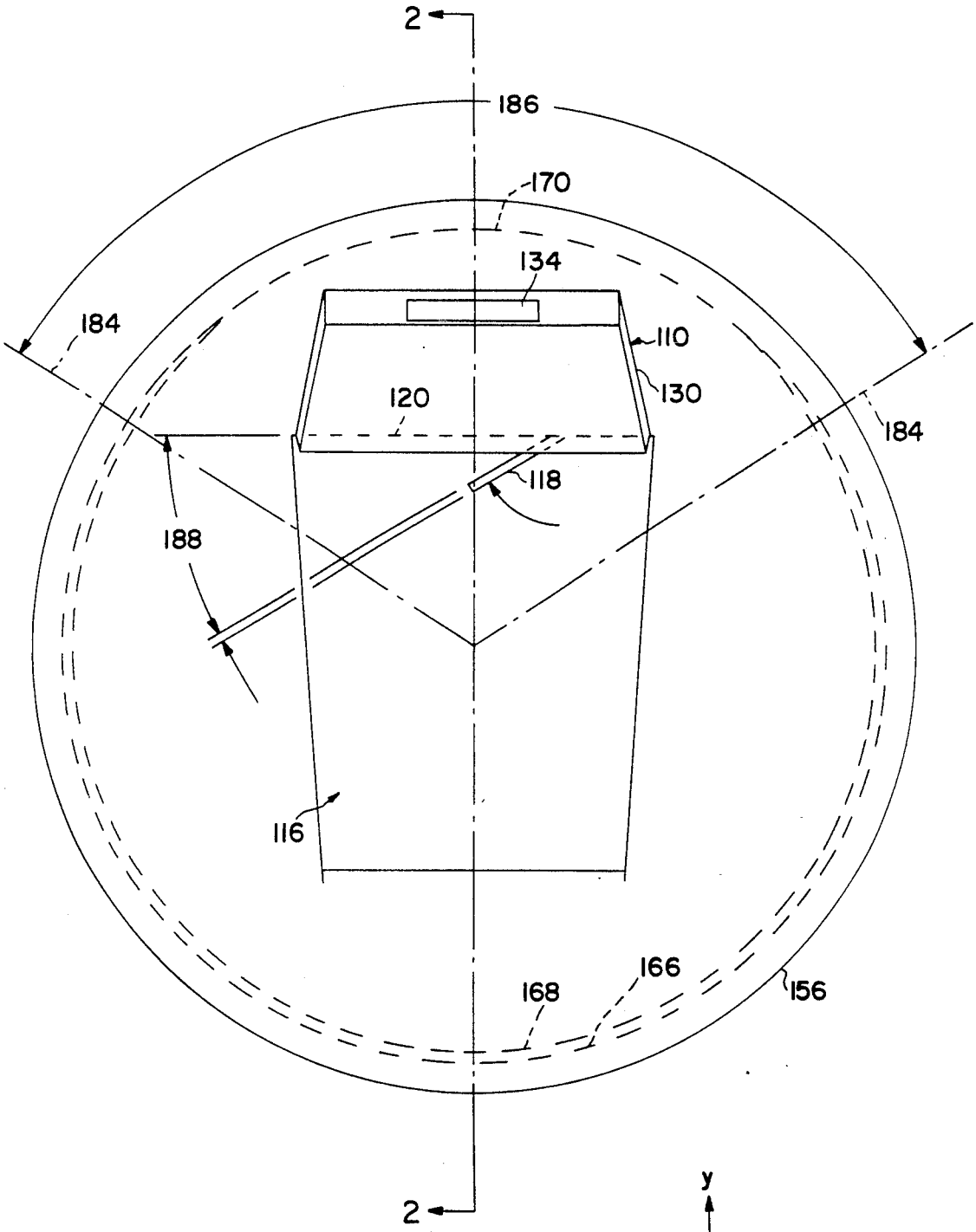
FIG. 4 is a top plan view of the closure of FIGS. 1-3.
Figure 5:
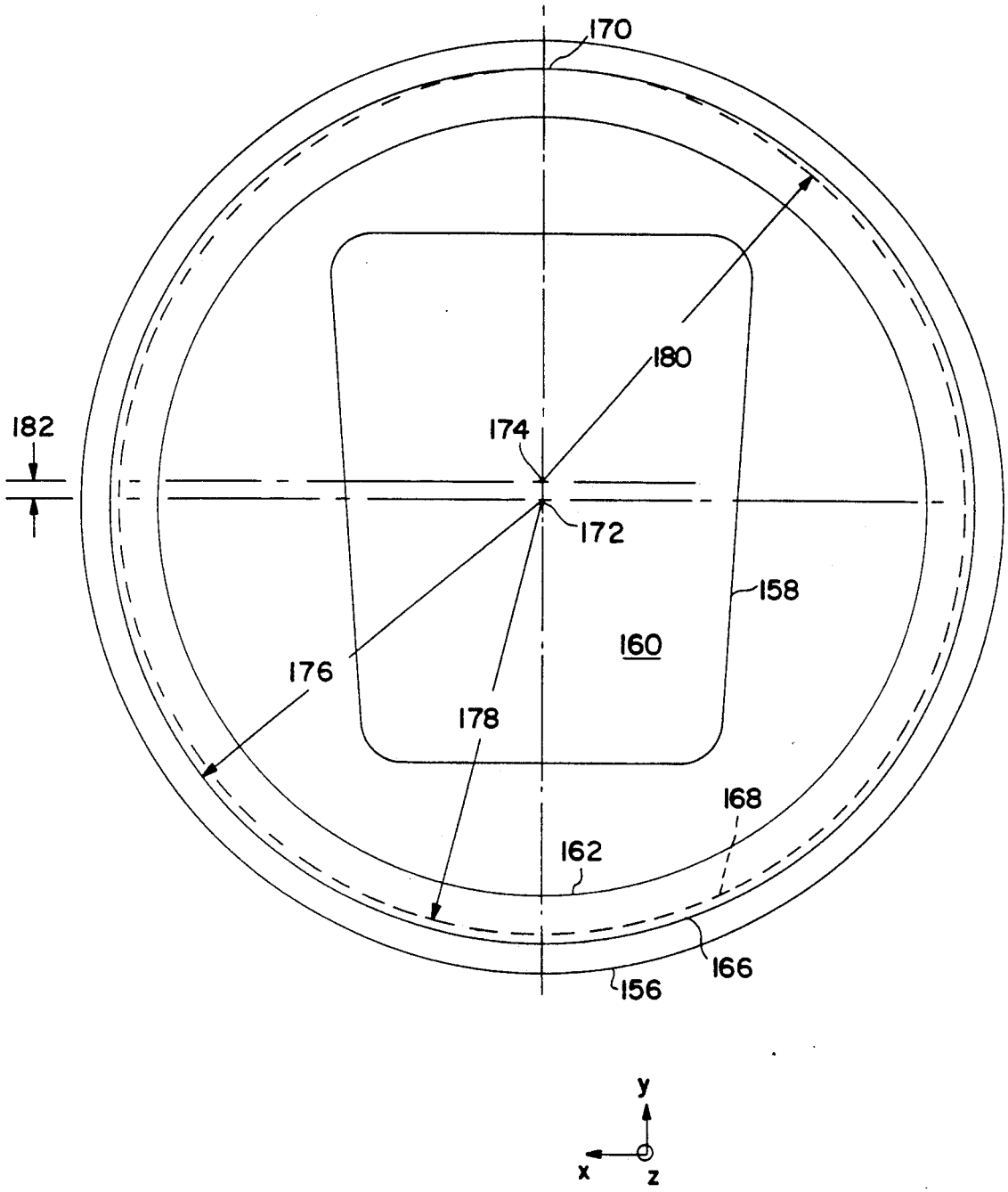
FIG. 5 is a bottom plan view of the closure of FIGS. 1-4.

The reduced depth region 202 extends circumferentially along an angular distance shown as 186 (FIGS. 4, 7). The angular extent 186 of the reduced depth region 202 is not highly critical and an optimum value of this extent will depend on the dimensions of the closure 100 and the container 240. For example, as seen in FIG. 4, the reduced depth region 202 may extend along about 115° of the circumference of the groove 198. However, larger or smaller extents could also be used, and the benefits of the present invention would be realized for reduced depth regions having angular extents in the range from about 10° to about 150° and preferably from about 60° to about 150°. These angular extents are respectively equivalent to about 3.5% and about 40% of the total circumference of the groove 198 or the cylindrical body wall 114. Thus, the non-reduced depth extends along an angular distance of from about 210° to about 350° and preferably from about 210° to about 300°.

A movable handle or tab 110 is attached to the cover plate 112 to aid a user in pulling the closure 100 from the container. The handle 110 is shown in a fully open position in FIGS. 1, 2 and 4, and in a fully closed position in FIG. 6. The handle 110 may be a substantially flat tab or plate structure 130. A protrusion 136 is provided on underside of tab 130 to aid the user in gripping the handle. The handle 110 is preferably constructed with the closure 100 as an integral part, and is preferably attached to the closure 100 using a living hinge 120. The handle 110 is shown in a preferred molding position in FIG. 2.

A well or recess 116 is provided in cover plate 112 to house the handle 110 when it is in a closed position. The recess 116 has side walls 158 with interior surfaces 146 and a bottom wall 160 with an interior surface 148. The recess 116 may be substantially trapezoidally shaped (see FIGS. 4–5). The interior wall surface 146 of recess 116 is relieved to form a region 152 opposite hinge 120 to receive the handle 110 when in its closed position. A ridge 154 (FIG. 2) is provided in the relieved region 152 to retain the handle 110 in that position. A mating ridge 134 is provided on the end of handle 110 for cooperation with ridge 154.

Except when the closure 100 is being removed from the container, the handle 110 is normally captured in the closed position, and its upper surface is substantially flush with the upper surface of the cover plate 112. The handle 110 and recess 116 preferably have complementary shapes so that the presence of the handle is concealed when the handle is in the closed position. In order to release the handle 110 from the closed position, the user applies downward pressure at a predefined location 132. A ridge 188 extends upward from the bottom of the recess 116. A bight 138 is provided in the bottom surface of tab 130 under location 132 to allow the tab 130 to flex when pressure is applied. Thus, when pressure is applied, the portion of tab 130 near bight 138 flexes, and the remaining portion of the tab 130 acts as a lever, using ridge 188 as a fulcrum. When sufficient downward pressure is applied at position 132, the outer end of the handle is forced upward out of the recess 116 and into the open position.

A resilient spring member 118 (FIGS. 1, 2 and 4) is provided to urge the handle 110 into a position angularly displaced f rom the cover plate 112 so that it may be conveniently gripped by the user. The spring member 118 may be any suitable resilient means for applying upward pressure on the handle 110, but it is preferably a substantially rectangular leaf member integrally formed with the closure 100 and extending into the recess 116. The spring member 118 is preferably attached to the interior bottom surface 148 of the bottom wall 160 of the recess 116 and is also attached to the rear interior side wall 150 of the recess 116. The rectangular spring preferably extends at an angle 122 of from about 20° to about 40° relative to the top edge of recess wall 150. The spring member 118 has a side edge 144 and a top edge 142. The handle 110 preferably has an angled surface 140 for contacting the spring member 118. When the handle 110 is forced into its closed position, surface 140 of the handle bears against the top edge 142 of the spring member 118, and the spring member is resiliently deflected. When the handle 110 is released from the closed position, pressure from spring member 118 against surface 140 urges the handle into a position 210 (FIG. 2) angularly displaced from the cover plate 112. The user can conveniently grip the handle 110 in that position.

Although we have shown an embodiment 100 wherein the closure is to be press fitted into a container neck or receiving member which has a corresponding flexible lip or bead to fit into the holding recess 198 (FIG. 2) the closure can have any of the normal closure constructions as shown in U.S. Pat. No. 3,845,872 whose disclosure for that purpose is incorporated herein. The closure would be improved by having our integral spring member 118 placed adjacent and below our living hinge.

Figure 9:
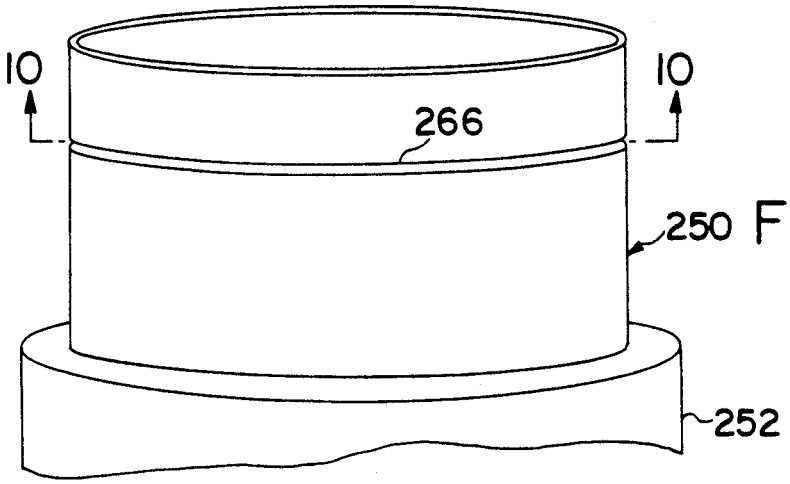
FIG. 9 is a side perspective view of a second alternative configuration for retaining means for the closure of FIGS. 1-6.

In addition, several additional configurations of the closure and container constructed according to the present invention are shown in in FIGS. 8–13. In FIG. 9, first and second mating mouth portions 250, 252 having generally round cross-sections are shown. Although the previously described embodiment has included an exemplary closure having a narrower mouth portion which is inserted into and received by the wider mouth of a container, the advantages of the present invention may also be achieved in applications in which the mouth portion of the closure is larger than that of the container, so that when the closure is installed, the container mouth extends into and is received by the closure.

Thus, in FIGS. 9, the smaller first mouth portion 250 may correspond to either the exterior wall of of the closure 100 or the exterior wall of the container 240, whichever is smaller and is inserted into the other. The second larger second mouth portion 252 correponds to the remaining one of the closure and container. A retaining means 266, which may be a circumferentially extending groove, is provided on the outer surface 258 of the first mouth portion 250. The groove 266 cooperates with a mating retaining means, which may be a lip or ridge (not shown, but see equivalent ridge 242 of FIG. 1) which is formed on the corresponding interior wall surface of the second mouth portion 252. The ridge 242 extends inwardly from the interior wall to seat in the groove 266 when the first mouth portion is installed into the second mouth portion.

Figure 10:
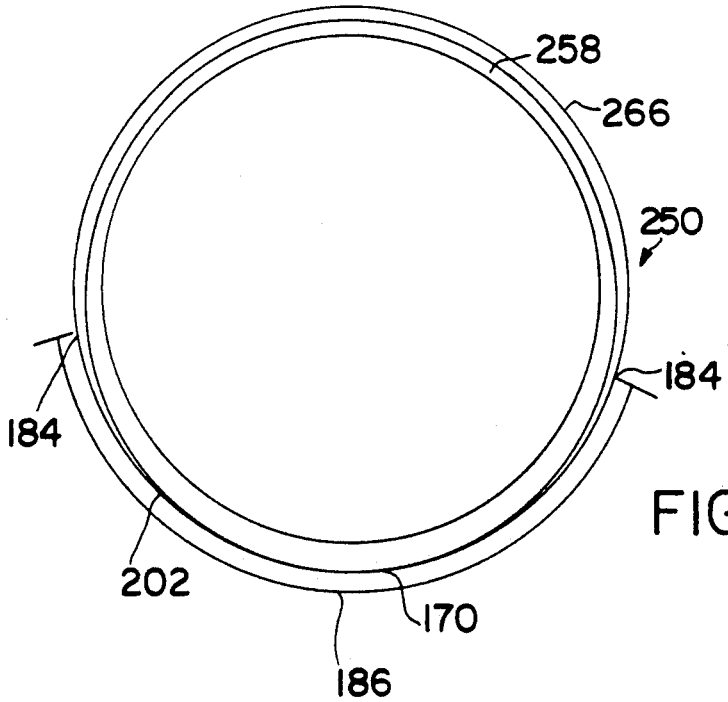
FIG. 10 is a cross section view of the retaining means configuration of FIG. 9, taken along the view lines 10—10 thereof.

The groove has a reduced depth region 202 extending along an angular distance 186 (FIG. 10). The reduced depth region 202 may extend circumferentially along the cylindrical wall for an angular distance of about 115°. However, larger or smaller extents could also be used, and the benefits of the present invention would be realized for reduced depth regions having angular extents in the range from about 10° to about 150° and preferably about 60° to 150°. These angular extents are respectively equivalent to about 3.5% and about 40% of the total circumference of the groove. The depth of the groove 266 is preferably gradually reduced from a maximum depth at the boundaries 184 of the reduced depth region 202 to a minimum depth position 170. The depth of the groove 266 at the minimum depth position 170 is preferably extremely small, and may be so small that the groove essentially vanishes in a region around that position. Thus, a region effectively having zero depth is provided including the minimum depth position 170. The zero depth region may extend for an angular distance of 5° to 10°. The ridge 242 on the interior wall of the second mouth portion 252 may be of uniform height, or its height may vary.

Figure 12:
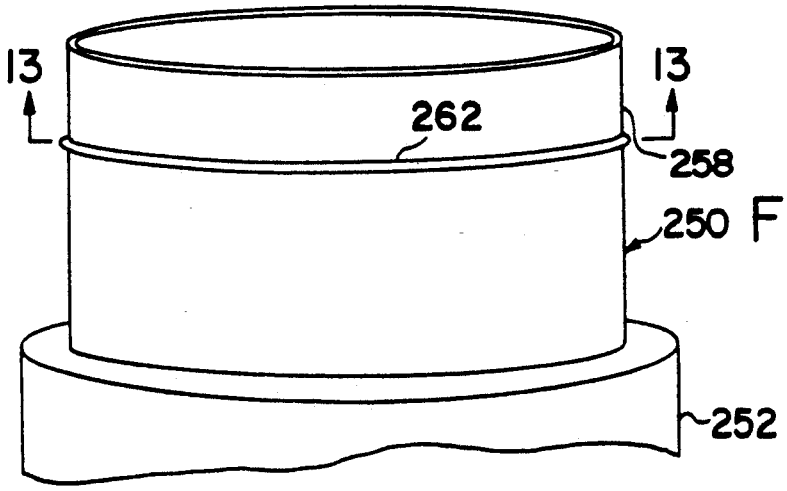
FIG. 12 is a side perspective view of a fourth alternative configuration for retaining means for the closure of FIGS. 1-6.
Figure 13:
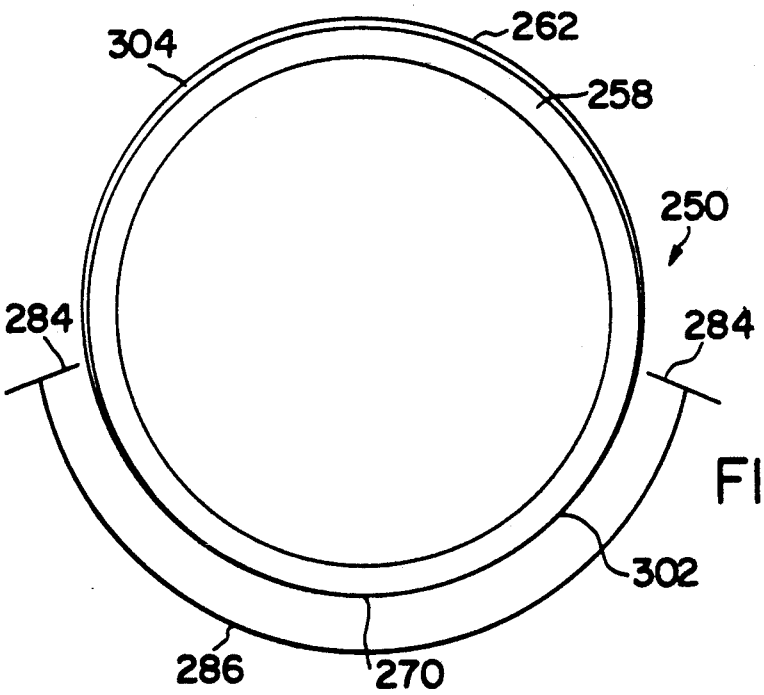
FIG. 13 is a cross section view of the retaining means configuration of FIG. 12, taken along the view lines 12—12 thereof.

In FIGS. 12–13, the first mouth portion has a construction similar to that shown in FIGS. 9–10. However, the groove 266 of FIGS. 9–10 is replaced with a small circumferential ridge or bead 262 extending outward from the outer surface 258 of the first mouth portion 250. The bead 262 cooperates with a groove (not shown) which may be formed on the interior wall of the second mouth portion 252. The groove extends into the interior wall of the second mouth portion to provide a receptacle into which bead 262 may seat when the first mouth portion is installed into the second mouth portion.

The bead 262 preferably has a first circumferential region 304 of substantially uniform height and a second circumferential region 302 of reduced height extending along an angular extent 286. The reduced height region 302 may extend circumferentially along the cylindrical wall for an angular distance of about 115°. However, larger or smaller extents could also be used, and the benefits of the present invention would be realized for reduced height regions having angular extents in the range from about 10° to about 150°. The height of the bead 262 is preferably gradually reduced from a maximum height at the boundaries 284 of the reduced height region 302 to a minimum height position 270. The height of the bead 262 at the minimum height position 270 is preferably extremely small, and may be so small that the bead vanishes at that position. Thus, a region effectively having zero height is provided including the minimum height position 170. The zero height region may extend for an angular distance of 5° to 10°. The receiving groove in the interior wall of the second mouth portion may be of uniform height, or its height may vary.

Figure 11:
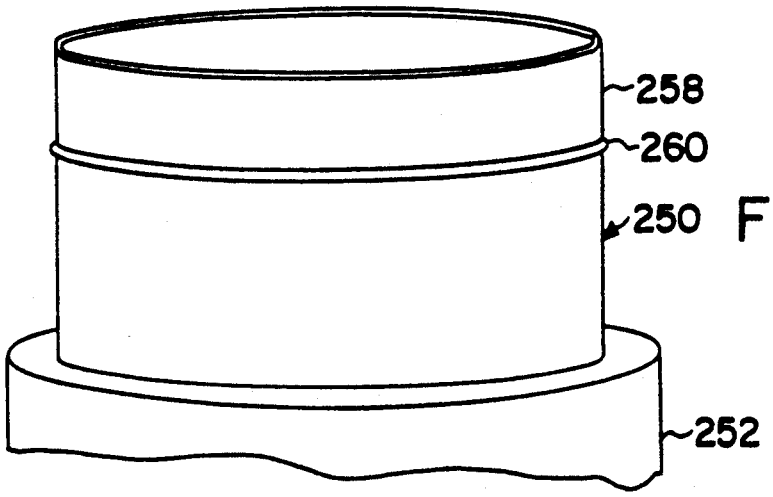
FIG. 11 is a side perspective view of a third alternative configuration for retaining means for the closure of FIGS. 1-6.

Although the previously described embodiments have incorporated a retaining groove or ridge element of variable height or depth for cooperation with a mating element (which may be of uniform height or depth) on the smaller first mouth portion 250, the first mouth portion 250 may instead have a retaining element of uniform height or depth for cooperation with a mating element of variable height or depth on the larger second mouth portion 252. Accordingly, in FIG. 8, a the smaller first mouth portion 250 is shown having a groove 264 of substantially uniform depth in the outer surface of the cylindrical wall 258 for cooperation with a mating ridge (not shown) provided on the interior wall of the larger second mouth portion 252. In FIG. 11, the first mouth portion is shown having a bead 260 of substantially uniform height in the outer surface of the cylindrical wall 258 for cooperation with a mating groove (not shown) provided in the interior wall of the second mouth portion.

As previously noted, either the closure's retaining means or the container's retaining means may have a portion of reduced depth or height to enable the closure to be more easily removed from the container.

The above-described embodiments of the invention are merely some examples of ways in which the invention may be carried out. Other ways may also be possible, and are within the scope of the following claims defining the invention.

What is claimed is:

1. In a child-resistant closure for a product container having: a substantially cylindrical body wall, a cover plate attached to the body wall, a movable handle attached to the cover plate, a recess in the cover plate for receiving the handle, the handle being releasably retained by the cover plate in a closed position in the recess; the improvement wherein:

said closure further comprises resilient means disposed in the recess for urging the handle into a position angularly displaced from the cover plate whenever the handle is released from its closed position; and said handle has one end thereof hinged to said cover plate and said resilient means contacts said handle adjacent said one end; and said resilient means is a leaf member extending from a bottom wall surface of the recess.

2. The closure of claim 1 wherein said resilient means is a leaf member integrally formed with said closure.

3. The closure of claim 1 wherein:

said handle is hinged to said cover plate, said resilient means extends from a surface of said recess and contacts a surface of said handle when said handle is closed to urge with a spring action said handle toward an open position; and said recess has at least one side wall surface and said resilient means is a leaf member extending from said side wall surface.

4. The closure of claim 1 wherein:

said handle is hinged to said cover plate, said resilient means extends from a surface of said recess and contacts a surface of said handle when said handle is closed to urge with a spring action said handle toward an open position; and said recess has at least one bottom wall surface and said resilient means is a leaf member extending from said bottom wall surface.

5. The closure of claim 1 wherein:

said handle is hinged to said cover plate, said resilient means extends from a surface of said recess and contacts a surface of said handle when said handle is closed to urge with a spring action said handle toward an open position; and said resilient means is a leaf member integrally formed with said closure.

6. In a child-resistant closure for a product container having: a body wall, the body wall having an exterior surface, a cover plate attached to the body wall, and first retaining means extending along the exterior surface of the body wall near the cover plate for engagement with a second means extending circumferentially on said product container, said first and second retaining means cooperating to retain the closure in a predetermined position in the container but to release the closure when a sufficient force is applied thereto; the improvement wherein:

a portion of one of said retaining means has a reduced size whereby the force required to release said closure from the container is reduced;

said closure comprises a handle, a recess in the cover plate for receiving the handle, the handle being releasably retained by the cover plate in a closed position in the recess, and resilient means disposed in the recess for urging the handle into a position angularly displaced from the cover plate whenever the handle is released from its closed position; and said handle has one end thereof hinged to said cover plate and said resilient means contacts said handle adjacent said one end; and said resilient means is a leaf member extending from a bottom wall surface of the recess.

7. In a child-resistant closure for a product container having: a body wall, the body wall having an exterior surface, a cover plate attached to the body wall, and first retaining means extending along the exterior surface of the body wall near the cover plate for engagement with a second means extending circumferentially on said product container, said first and second retaining means cooperating to retain the closure in a predetermined position in the container but to release the closure when a sufficient force is applied thereto; the improvement wherein:

a portion of one of said retaining means has a reduced size whereby the force required to release said closure from the container is reduced;

said closure comprises a handle, a recess in the cover plate for receiving the handle, the handle being releasably retained by the cover plate in a closed position in the recess, and resilient means disposed in the recess for urging the handle into a position angularly displaced from the cover plate whenever the handle is released from its closed position; and said handle has one end thereof hinged to said cover plate and said resilient means contacts said handle adjacent said one end; and said resilient means is a leaf member integrally formed with said closure.

* * * * *